US006464600B2

(12) United States Patent
Takemura et al.

(10) Patent No.: US 6,464,600 B2
(45) Date of Patent: Oct. 15, 2002

(54) GOLF BALL

(75) Inventors: Kohei Takemura, Kobe (JP); Seigou Sakagami, Kobe (JP); Hiroyuki Kishimoto, Kobe (JP)

(73) Assignee: Sumitomo Rubber Industries, Inc., Hyogo-ken (JP)

( * ) Notice: Subject to any disclaimer, the term of this patent is extended or adjusted under 35 U.S.C. 154(b) by 74 days.

(21) Appl. No.: 09/749,697

(22) Filed: Dec. 28, 2000

(65) Prior Publication Data

US 2001/0029211 A1 Oct. 11, 2001

(30) Foreign Application Priority Data

Dec. 28, 1999 (JP) ..... 11-373763

(51) Int. Cl.[7] ..... A63B 37/06; A63B 37/04; A63B 37/12; A63B 37/14

(52) U.S. Cl. ..... 473/378; 473/377; 473/365

(58) Field of Search ..... 473/351–377, 473/378

(56) References Cited

U.S. PATENT DOCUMENTS 4,264,075 A * 4/1981 Miller et al. ..... 260/998.14
5,559,188 A 9/1996 Egashira et al.
5,961,401 A * 10/1999 Masutani et al. ..... 473/374
5,981,654 A * 11/1999 Rajagopalan ..... 473/371
5,989,136 A * 11/1999 Renard et al. ..... 473/373
6,001,930 A * 12/1999 Rajagopalan ..... 473/354
6,186,906 B1 * 2/2001 Sullivan et al. ..... 273/DIG. 20
6,245,862 B1 * 6/2001 Rajagopalan ..... 473/373
6,251,030 B1 * 6/2001 Kato et al. ..... 473/363
6,290,613 B1 * 9/2001 Irii et al. ..... 473/377
6,359,066 B1 * 3/2002 Yabuki ..... 473/354

* cited by examiner

*Primary Examiner*—Paul T. Sewell
*Assistant Examiner*—Alvin A. Hunter
(74) *Attorney, Agent, or Firm*—Birch, Stewart, Kolasch & Birch, LLP

(57) ABSTRACT

The present invention provides a golf ball having high rebound characteristics and exceptional controllability at approach shot from the rough, which accomplished by controlling its cover material morphology. The present invention relates a golf ball comprising a core and a cover covering the core, wherein the base resin of the cover is formed from a material having at least two phases whose phase angle difference is at least 2 degrees as measured by using an atomic force microscope; a maximum phase angle phase, which is contained in the base resin of the cover and has an absolute value of a maximum phase angle, is present in the form of a continuous matrix; and a minimum phase angle phase, which has an absolute value of a minimum phase angle, is present in discrete locations within the matrix.

2 Claims, No Drawings

GOLF BALL

FIELD OF THE INVENTION

The present invention relates to a golf ball having high rebound characteristics and exceptional controllability at approach shot from the rough, which accomplished by controlling its cover material morphology.

BACKGROUND OF THE INVENTION

There have been various requirements for physical properties of golf balls, such as flight distance, controllability, shot feel, click sound and the like. Among these, the controllability is rated by top-rank golfers as one of the most important properties for scoring; especially when approach shots are made from the rough. As such, a technique used to improve controllability involves making the cover softer, which increases the amount of spin, even when approach shots are made from the rough. However, golf balls obtained using such a technique suffer from the drawbacks of diminished rebound characteristics and reduced flight distance.

OBJECTS OF THE INVENTION

A main object of the present invention is to provide a golf ball which has high rebound characteristics and exceptional controllability at approach shot from the rough.

According to the present invention, the object described above has been accomplished by forming a base resin of a cover from a material having at least two phases, and setting the phase angle difference of these phases, as measured by an atomic force microscope to within a specific range to control the morphology in such a way that the phase that is contained in the base resin of the cover, which has the maximum phase angle, is present in the form of a continuous matrix, and the phase with the minimum phase angle is present in discrete locations within the matrix, thereby providing a golf ball having high rebound characteristics and exceptional controllability at approach shot from the rough, even when hit through grass or when wet conditions tend to limit the amount of spin when approach shots are made from the rough.

SUMMARY OF THE INVENTION

The present invention relates to a golf ball comprising a core and a cover covering the core, wherein the base resin of the cover is formed from a material having at least two phases whose phase angle difference is at least 2 degrees as measured by using an atomic force microscope; a maximum phase angle phase, which is contained in the base resin of the cover and has an absolute value of a maximum phase angle, is present in the form of a continuous matrix; and a minimum phase angle phase, which has an absolute value of a minimum phase angle, is present in discrete locations within the matrix.

In order to put the present invention into a more suitable practical application, it is desired that the minimum phase angle phase have a mean dispersion particle size of no more than 700 nm.

It is universally accepted that the less hardness a golf ball cover material has, the more spin will result; however, it goes without saying that low hardness also causes a decrease in rebound characteristics and durability. Using a hard material, accordingly, in order to obtain an increase in the rebound characteristics and durability, translates into diminished spin performance. Upon conducting diligent research on the cover material, the inventors of the present invention discovered that by fabricating the cover from a specific material, and also by using such materials in combination, will result in an increase in both the rebound characteristics and the durability. The inventors predicted that the appearance of these properties was related to the phase structure (morphology) of the material, and by using an atomic force microscope to analyze the morphology, which is not observable using common electronic microscopes, it was discovered that the cover contains a so-called "sea-island" structure, wherein the maximum phase angle phase, which contains the largest phase angle in the material used in the base resin of the cover, is present in a continuous matrix ("sea"), and the minimum phase angle phase, which contains the smallest phase angle, is present in discrete locations ("islands") within the "sea", and in the cover there exists a very strong correlation between the phase angle difference of the minimum phase angle phase and the maximum phase angle phase in the material used in the base resin of the cover, the amount of spin and the rebounding performance. Moreover, it is preferable for the mean dispersion particle size in the minimum phase angle phase ("islands") to be no greater than 700 nm.

DETAILED DESCRIPTION OF THE PREFERRED EMBODIMENTS

In the detailed description of the present invention which follows, the golf ball of the present invention comprises a core and a cover formed on said core. The core used in the golf ball of the present invention may be e.g. a solid core (of a single layer structure or one comprising two or more layers) or a thread-wound core. Examples of materials which can be used as a solid core include thermoplastic elastomers, thermoplastic resins or rubber compositions which comprise a base rubber, an organic peroxide, a co-crosslinking agent and the like. Of these, the rubber compositions are preferable.

In solid cores as described above, the base rubber may be natural and/or synthetic rubber, which has been conventionally used for solid golf balls. Preferred is so-called high-cis polybutadiene rubber containing a cis-1,4-structure of not less than 40%, preferably not less than 80% and even more preferably not less than 90%. According to need, the high-cis polybutadiene rubber can be mixed with natural rubber, polyisoprene rubber, styrene butadiene rubber or ethylene-propylene-diene rubber (EPDM) and the like in amount of 0 to 50 parts by weight, based on 100 parts by weight of the base rubber.

Examples of co-crosslinking agents include $\alpha,\beta$-unsaturated carboxylic acids with 3 to 8 carbon atoms (e.g. acrylic acid, methacrylic acid, etc.), a mono- or bivalent metal salt such as the zinc or magnesium salt thereof, functional monomers such as triethanolpropane trimethacrylate and mixtures thereof. The preferred co-crosslinking agent is zinc acrylate because it imparts high rebound characteristics to the resulting golf ball. The amount of the co-crosslinking agent is 5 to 50 parts by weight, and preferably 10 to 40 parts by weight, based on 100 parts by weight of the base rubber. When the amount is larger than 50 parts by weight, the core is too hard, and the shot feel is poor. On the other hand, when the amount is smaller than 5 parts by weight, an appropriate level of hardness is not obtained, and the rebound characteristics are severely degraded, which reduces the flight distance.

Examples of organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide and the like. The preferred organic peroxide is dicumyl peroxide because it imparts high rebound characteristics to the resulting golf ball. The amount of the organic peroxide is 0.1 to 5.0 parts by weight, and preferably 0.2 to 3.0 parts by weight, based on 100 parts by weight of the base rubber. When the amount is smaller than 0.1 parts by weight, the core becomes too soft, the rebound characteristics are degraded, which reduces the flight distance. On the other hand, the amount is larger than 5.0 parts by weight, the core becomes too hard, which causes cracks to form.

Where appropriate, it is possible to compound a component which is typically used in the manufacture of solid golf ball cores together with the rubber composition; e.g., fillers such as zinc oxide, barium sulfate and the like as a specific gravity regulator, and other additives such as antioxidants, peptizing agents and organic sulfide compounds. Preferably the amount of the filler is 5 to 50 parts by weight, the amount of the antioxidant is 0.1 to 5 parts by weight, the amount of the peptizing agent is 0.1 to 5 and the amount of the organic sulfide compound is 0.1 to 2 parts by weight, based on 100 parts by weight of the base rubber.

A method for manufacturing the core when a rubber composition is used involves the rubber composition to be used in the core being mixed and then press-molded under applied heat of e.g. 140 to 165° C. for 10 to 40 minutes in a mold with upper/lower sections containing hemispherical cavities, and when a thermoplastic resin is used, involves injection molding the composition for the core using a similar mold. Multi-piece solid cores containing at least two layers can be obtained by forming the compositions for the core in a laminar structure. A method for manufacturing multi-piece solid cores when a rubber composition is used involves the composition for the core first being molded into a semi-vulcanized hemispherical half-shell, then using two half-shell to wrap a single layer structure core as mentioned in the foregoing, and molding the whole under applied pressure at 130 to 180° C. for 5 to 60 minutes, and when a thermoplastic resin is used, involves the single layer structure core becoming encased in the composition for the core as described in the foregoing by injection molding the composition directly thereon. The surface of the resulting core may be buff-ground in order to enhance the tight adhesion between it and the cover. In order to enhance the tight adhesion between the cover and multi-piece solid cores, as well as between the layers of the core, the surface of the core may be buff-ground prior to having it be covered with the adjacent outer layer.

In thread-wound cores as described above, conventionally used thread-wound cores are suitable for use, with the core comprising a center and a thread rubber layer formed by winding a thread rubber in an elongated state around the center. The center may be liquid-based ("liquid center") or rubber-based ("solid center"). The thread rubber used for winding around the center may be of the same kind which is conventionally used in thread-wound layers in thread-wound golf balls; e.g., it can be obtained by vulcanizing a rubber composition in which natural rubber or natural rubber and synthetic polyisoprene have been compounded with sulfur, a vulcanization aid, vulcanization accelerator, antioxidant and the like. A thread-wound core can be produced by drawing the thread rubber about 1000% over the center and winding it there. However, such solid and thread-wound cores are given by way of illustrative examples only, and the invention shall not be limited thereto.

The diameter of the core is 36.8 to 41.2 mm, and preferably 37.8 to 40.8 mm. When the core diameter is smaller than 36.8 mm, the cover will become too thick, which will cause the rebound characteristics to degrade, owing to the increasing volume fraction of the cover component. On the other hand, when the diameter is larger than 41.2 mm, the cover will become too thin, and the durability is poor.

Next, the core is covered with a cover. It is required that the base resin of the cover of the present invention comprise a material which has at least two phases in which the phase angle difference as measured by an atomic force microscope is at least 2°, preferably 2 to 45°, and even more preferably 2 to 20°, and have a "sea-island" phase structure, in which the maximum phase angle phase, which contains the largest phase angle in the material used in the base resin of the cover, is present in a continuous matrix ("sea"), and the minimum phase angle phase, which contains the smallest phase angle, is present in discrete locations ("islands") within the "sea". If the phase angle difference as measured by an atomic force microscope between the two or more phases in the cover material is smaller than 2°, the strength in the direction of shear will be insufficient, and particularly when an approach shot is made from the rough, there will be reduced backspin, leading to poor spin performance. Moreover, if the phase structure of the cover assumes a connected phase as opposed to a "sea-island" structure, the cover will become hard, and, particularly when an approach shot is made from the rough, there will be reduced backspin amount, leading to poor spin performance. Conversely, the more the phase angle difference exceeds 45°, the lower the cover durability will be. Also, if the minimum phase angle phase, which contains the smallest phase angle, is present in a continuous matrix ("sea"), and the maximum phase angle phase, which contains the largest phase angle, is present in discrete locations ("islands") within the "sea", the cover will become too hard, and particularly when an approach shot is made from the rough, the spin amount will be reduced, leading to poor controllability. It is moreover desirable for the minimum phase angle phase in the cover used in the golf ball of the present invention to have a mean dispersion particle size of no more than 700 nm, preferably of no more than 600 nm, even more preferably of no more than 500 nm and even still more preferably of no more than 200 nm. If the mean dispersion particle size is larger than 700 nm, the cover will become hard, and particularly when an approach shot is made from the rough, the backspin amount will be reduced, leading to poor spin performance. It is preferable for the mean dispersion particle size to be as small as possible; however, it is desirable for it to remain at least 1 nm, preferably at least 10 nm and even more preferably at least 50 nm.

The phrase, "the phase angle as measured by an atomic force microscope" as used herein shall refer to the fact that a model SPI-300HV atomic force microscope manufactured by Seiko Instruments inc. is used, that a cantilever with a 40 N/m spring constant, to which a probe has been attached, is used in 200 to 350 Hz frequency conditions, and that the phase angle is measured in "phase mode", which is the mode for measuring phase angles. In other words, the probe which is attached to the cantilever, which vibrates at the frequencies, is brought into contact with the samples, and the response is detected using reflected laser light. The energy loss will be greater in the soft areas of the sample, and as such the phase delay; i.e., the phase angle, will be greater. By scanning the sample surface while the cantilever is made to vibrate, an image can be obtained whereby the sample surface is color-coded according to phase angle size. The dispersion particle size of the minimum phase angle phase can be determined from this image.

It is desirable for the cover of the present invention to have a thickness of 0.84 to 3.00 mm and preferably of 1.0 to 2.5 mm. When the thickness of the cover is smaller than 0.84 mm, then the cover will be less durable and become damaged, while when its thickness is larger than 3.00 mm, the rebound characteristics will be degraded, or the shot feel will be hard and thereby not as good.

Examples of materials to be used in the base resin in the cover of the present invention, which will form the minimum phase angle phase, include so-called ionomer resins, in which at least a portion of the carboxyl groups in a copolymer of an α-olefin and an α,β-unsaturated carboxylic acid have been neutralized with metal ions. Examples of the α-olefins contained in the ionomer resin preferably include ethylene and propylene, while examples of the α,β-unsaturated carboxylic acid preferably include acrylic acid and methacrylic acid. Examples of the neutralizing metal ions include alkaline metal ions; e.g. sodium, potassium and lithium ions, bivalent metal ions; e.g., zinc, calcium and magnesium ions, trivalent metal ions; e.g., aluminum and neodymium ions, and mixtures thereof. However, among these, sodium, zinc and lithium ions are preferably used due to their rebound characteristics and durability. Specific examples of the ionomer resin are not limited to the above; Hi-milan 1555, 1557, 1605, 1706, 1707, AM7315 and AM 7317 (Mitsui Du Pont Polychemical Co., Ltd.), Surlyn 7930, 8511, 8512 (Du Pont Co.), and Iotek 7010 and 8000 (Exxon Chemical Co.) can all be given as examples. The ionomers may each be used alone or in combinations of two or more.

Examples of materials to be used in the base resin in the cover of the present invention, which will form the maximum phase angle phase, include thermoplastic resins or thermoplastic elastomers. Specific examples are not limited thereto; other examples include styrene-based thermoplastic elastomers commercially available from Asahi Chemical Industry Co., Ltd., under the trade name "Tuftec" (e.g., Tuftec H1051); polyester-based thermoplastic elastomers commercially available from Toray-Du Pont Co., Ltd., under the trade name "Hytrel" (e.g., Hytrel 3548 and Hytrel 4047); polyamide-based thermoplastic elastomers commercially available from Toray Co., Ltd., under the trade name "Pebax" (e.g., Pebax 4033SN); polyurethane-based thermoplastic elastomers commercially available from Dainippon Ink & Chemicals Inc., under the trade name "Pandex" (e.g., Pandex T-7298); and polyurethane-based thermoplastic elastomers commercially available from Takeda Badische Urethane Industries, Ltd., under the trade name "Elastollan" (e.g., Elastollan ET890).

However, the thermoplastic elastomers have a morphology whereby the soft rubber portion and the hard crystalline portion are mixed together, and therefore the cover of the present invention can be constituted from them alone. In other words, the thermoplastic elastomers have a phase structure whereby the soft rubber portion, which has the largest phase angle, is present in a continuous matrix ("sea"), and the hard crystalline portion, which has the smallest phase angle, is present in discrete locations ("islands") within the matrix, and the difference between the two phase angles is at least 2°.

Other than the base resin, any of various additives; e.g., pigments such as titanium dioxide, dispersants, antioxidants, UV absorbers, photostabilizers etc. may be added as needed to the cover of the present invention.

In other words, the present invention specifically comprises the following three embodiments.

(i) a golf ball comprising a core and a cover which has been applied to said core, wherein said cover comprises a base resin which comprises an ionomer resin and a thermoplastic resin and which comprises a material which contains at least two phases in which the phase angle difference as measured by an atomic force microscope is at least 2°; the maximum phase angle phase, which contains the largest phase angle, and which is contained in the base resin of said cover, being present in a continuous matrix, and the minimum phase angle phase, which contains the smallest phase angle, being present in discrete locations in said matrix.

(ii) a golf ball comprising a core and a cover which has been applied to said core, wherein said cover comprises a base resin which comprises an ionomer resin and a thermoplastic elastomer and which comprises a material which contains at least two phases in which the phase angle difference as measured by an atomic force microscope is at least 2°; the maximum phase angle phase, which has the largest phase angle, and which is contained in the base resin of said cover, being present in a continuous matrix, and the minimum phase angle phase, which has the smallest phase angle, being present in discrete locations in said matrix.

(iii) a golf ball comprising a core and a cover which has been applied to said core, wherein said cover comprises a base resin, which comprises a thermoplastic elastomer and which comprises a material which contains at least two phases in which the phase angle difference as assessed by an atomic force microscope is at least 2°; the maximum phase angle phase, which has the largest phase angle, and which is contained in the base resin of said cover, being present in a continuous matrix, and the minimum phase angle phase, which has the smallest phase angle, being present in discrete locations in said matrix.

In the embodiment (i), a thermoplastic resin is used as a material which forms the maximum phase angle phase, and an ionomer resin is used as a material which forms the minimum phase angle phase, with the thermoplastic resin thought to form the "sea" portion, and the ionomer resin thought to constitute the "island" portions.

In the embodiment (ii), the thermoplastic elastomer alone provides the "sea-island" structure, which is normal, as mentioned in the foregoing; however, it is thought here that the thermoplastic elastomer forms the "sea", containing the large phase angle, and therein the ionomer resin forms the relatively harder "island" portions. Consequently, it is necessary in this embodiment for the phase angle difference between the maximum phase angle phase and the minimum phase angle phase in such a material to be at least 2°.

In the embodiment (iii), the structure is constituted solely by the thermoplastic elastomer, and, as mentioned in the foregoing, the soft rubber portion and the hard crystalline portion are mixed together in the thermoplastic elastomer, and it is therefore thought that the soft portion forms the "sea" portion, while the hard portion constitutes the "island" portions.

It is moreover possible to obtain the desired phase structure by adjusting not only the type of structural component in the maximum phase angle phase and minimum phase angle phase of the material used in the base resin of the cover, but also e.g. the viscosity, volume fraction, temperature during kneading and shear strength during kneading of both aforesaid phases. In other words, if the types of structural components of the cover base resin material are the same, then by changing the other aforesaid factors it is possible to obtain a phase structure whereby the structures of the maximum phase angle phase and the minimum phase angle phase are reversed.

A method of covering on the core with the cover is not specifically limited, but may be a conventional method. For example, there can be used a method comprising molding the cover composition into a hemispherical half-shell in advance, covering the core with the two half-shells, followed by pressure molding at 130 to 170° C. for 1 to 5 minutes, or a method comprising injection molding the cover composition directly on the core to cover it. At the time of molding the cover, dimples may be optionally formed on the surface of the golf ball. Furthermore, paint finishing or marking with a stamp may be optionally provided after the cover is molded. The multi-piece solid golf ball of the present invention is formed to a diameter of at least 42.67 mm and a weight of no more than 45.93 g, in accordance with the regulations for golf balls.

The cover of the present invention may have a single layer structure, or a multi-layered structure comprising two or more layers; in the event that a multi-layered cover structure is adopted, the outermost layer should satisfy the phase structure and properties as described in the foregoing.

Through controlling the cover material morphology, it is possible with the present invention to provide a golf ball which has high rebound characteristics and exceptional controllability, even when approach shots are made from the rough.

EXAMPLES

The following Examples and Comparative Examples illustrate the present invention in further detail, but are not to be construed to limit the scope of the present invention.

Production of the core

The rubber composition for the core having the formulation shown in Table 1 was mixed, and the mixture was then press-molded at 160° C. for 25 minutes in a mold, which is composed of an upper mold and a lower mold having a hemispherical cavity, to obtain a spherical core having a diameter of 39.0 mm.

TABLE 1

| Core composition | | Amount (parts by weight) |
|---|---|---|
| BR01 | (Note 1) | 100 |
| Zinc acrylate | (Note 2) | 30 |

TABLE 1-continued

| Core composition | | Amount (parts by weight) |
|---|---|---|
| Zinc oxide | (Note 3) | 20 |
| Dicumyl peroxide | (Note 4) | 0.8 |

(Note 1): High-cis polybutadiene rubber available from JSR Co., Ltd., (1,4-cis-polybutadiene content: 97.1%)
(Note 2): Zinc acrylate available from Asada Chemical Co., Ltd.
(Note 3): Zinc oxide available from Toho Zinc Co., Ltd.
(Note 4): Dicumyl peroxide commercially available from Nippon Oil & Fat Co., Ltd., under the trade name "Percumyl D"; half-life period at 175° C.: 1.5 min.

Examples 1 to 5, 7 to 9 and Comparative Examples 1 to 3

The formulation materials shown in Tables 2 and 3, and, as suitable, a pigment (Note 10), a specific gravity adjusting agent (Note 11) and the like were mixed using a kneading type twin-screw extruder to obtain cover compositions. Golf balls having a diameter of 42.8 mm were produced by covering the resulting core as described above with the cover compositions by injection molding to form a cover layer having a thickness of 1.9 mm. With respect to the resulting covers, the phase angle and mean dispersion particle size of the minimum phase angle phase were measured and the results are shown in Tables 4 to 6. With respect to the resulting golf balls, the coefficient of restitution, spin amount and controllability at rough shot were measured or evaluated, and the results are shown in Tables 4 to 6. The test methods are described later.

Example 6

The formulation material shown in Tables 2, and, as suitable, a pigment (Note 10), a specific gravity adjusting agent (Note 11) and the like was mixed, and the mixtures was then press-molded at 120° C. for 20 minutes into hemispherical half-shells for the cover. The resulting core as described above was covered with the two half-shells, and then cured at 120° C. for 1 hour to obtain golf ball having a diameter of 42.8 mm. With respect to the resulting cover, the phase angle and mean dispersion particle size of the minimum phase angle phase were measured and the results are shown in Tables 4 to 6. With respect to the resulting golf ball, the coefficient of restitution, spin amount and controllability at rough shot were measured or evaluated, and the results are shown in Table 5. The test methods are described later.

TABLE 2

(parts by weight)

| | Example No. | | | | | | | | |
|---|---|---|---|---|---|---|---|---|---|
| Cover composition | 1 | 2 | 3 | 4 | 5 | 6 | 7 | 8 | 9 |
| Thermoran 3981N (Note 5) | 100 | — | — | — | — | — | — | — | — |
| Tuftec H1051 (Note 6) | — | 100 | — | — | — | — | — | 50 | 50 |
| Elastollan ET890 (Note 7) | — | — | 100 | — | — | — | — | — | — |
| Perprene P-40B (Note 8) | — | — | — | 100 | — | — | — | — | — |
| Pebax 4033SN (Note 9) | — | — | — | — | 100 | — | — | — | — |
| MOCA (Note 12) | — | — | — | — | — | 36 | — | — | — |
| Sumiphen 3600 (Note 13) | — | — | — | — | — | 64 | — | — | — |

TABLE 2-continued (parts by weight)

| Cover composition | Example No. 1 | 2 | 3 | 4 | 5 | 6 | 7 | 8 | 9 |
|---|---|---|---|---|---|---|---|---|---|
| PPG/TDI prepolymer (Note 14) | — | — | — | — | — | 100 | — | — | — |
| Pandex T7298 (Note 15) | — | — | — | — | — | — | 100 | — | — |
| Desmodule TT (Note 16) | — | — | — | — | — | — | 1 | — | — |
| Hi-milan 1605 (Note 17) | — | — | — | — | — | — | — | 25 | 25 |
| Hi-milan 1706 (Note 18) | — | — | — | — | — | — | — | 25 | 25 |
| Plasticizer (Note 19) | — | — | — | — | — | — | — | 20 | 10 |

TABLE 3

(parts by weight)

| Cover composition | | Comparative Example No. 1 | 2 | 3 |
|---|---|---|---|---|
| Tuftec H1051 | (Note 6) | 50 | — | — |
| Hi-milan 1605 | (Note 17) | 25 | 50 | — |
| Hi-milan 1706 | (Note 18) | 25 | 50 | — |
| Hi-milan 1557 | (Note 20) | — | — | 35 |
| Hi-milan 1856 | (Note 21) | — | — | 35 |
| Dynaron E6100P | (Note 22) | — | — | 30 |
| Plasticizer | (Note 19) | — | — | — |

(Note 5): Trade name "Thermoran 3981N"; olefin-based thermoplastic elastomer available from Mitsubishi Chemical Co., Ltd.
(Note 6): Trade name "Tuftec H1051"; styrene-based thermoplastic elastomer available from Asahi Chemical Industry Co., Ltd.
(Note 7): Trade name "Elastollan ET890"; polyurethane-based thermoplastic elastomer available from Takeda Verdishe Urethane Industries Co., Ltd.
(Note 8) : Trade name "Perprene P-40B"; polyester-based thermoplastic elastomer available from Toyobo Co., Ltd.
(Note 9): Trade name "Pebax 4033SN"; polyamide-based thermoplastic elastomer available from Toray Co., Ltd.
(Note 10): Trade name "A100"; titanium dioxide available from Ishihara Sangyo Co., Ltd.
(Note 11): Trade name "BHM"; barium sulfate available from Sakai Chemical Co., Ltd.
(Note 12): Trade name "MOCA"; 3,3'-dichloro-4,4'-diaminodiphenylmethane available from Sumitomo Bayer Urethane Co., Ltd.
(Note 13): Trade name "Sumiphen 3600"; polyurethane prepolymer available from Sumitomo-Bayer Urethane Co., Ltd.
(Note 14): polypropylene glycol/tolylene diisocyanate prepolymer
(Note 15): Trade name "Pandex T7298"; polyamide-based thermoplastic elastomer available from Toray Co., Ltd.
(Note 16): Trade name "Desmodule TT"; dimer of 2,4-toluene diisocyanate (Sumitomo-Bayer Urethane Co., Ltd.)
(Note 17): Trade name "Hi-milan 1605"; ethylene-methacrylic acid copolymer ionomer resin obtained by neutralizing with sodium ion, available from Mitsui Du Pont Polychemical Co., Ltd.
(Note 18): Trade name "Hi-milan 1706"; ethylene-methacrylic acid copolymer ionomer resin obtained by neutralizing with zinc ion, available from Mitsui Du Pont Polychemical Co., Ltd.
(Note 19): Trade name "PW380"; paraffin oil available from Idemitsu Kosan Co., Ltd.
(Note 20): Trade name "Hi-milan 1557"; ethylene-methacrylic acid copolymer ionomer resin obtained by neutralizing with sodium ion, available from Mitsui Du Pont Polychemical Co., Ltd.
(Note 21): Trade name "Hi-milan 1856"; ethylene-methacrylic acid-acrylic acid ester terpolymer ionomer resin obtained by neutralizing with sodium ion, available from Mitsui Du Pont Polychemical Co., Ltd.
(Note 22): Trade name "Dynaron E6100P"; block copolymer thermoplastic elastomer containing crystalline olefin blocks on both terminals, available from JSR Co., Ltd.

(Test method)

(1) Phase angle 10 mm (length)×10 mm (width)×1 mm (thickness) square samples were cut from the golf ball cover, and, by using a model SPI-300HV atomic force microscope (apparatus) and model 3800N (unit) (Seiko Instruments Inc.) in the phase angle measuring mode ("phase mode"), a cantilever which had a spring constant of 40 N/m, to which a probe was attached, was caused to vibrate at 250 Hz to determine the phase angle, which was measured at 23° C. in nitrogen. Specifically, the probe, which is attached to the cantilever that is caused to vibrate at the frequency, is brought into contact with the samples, and the phase angle can be obtained by detecting its response through the use of reflected laser light. The energy loss is greater in the areas where the sample is soft, and as such the phase delay; i.e., the phase angle, increases. Scanning the sample surface while the cantilever vibrates causes an image to be obtained whereby the sample surface is color-coded according to the phase angle size. The dispersion particle size of the minimum phase angle phase can be determined from this image.

(2) Coefficient of restitution

A cylindrical aluminum projectile having weight of 200 g was struck at a speed of 49 m/sec against a golf ball, and the velocity of the projectile and the golf ball before and after the strike were measured using a laser. The coefficient of restitution of the golf ball was calculated from the velocity and the weight of both the projectile and the golf ball. The measurements were conducted five times for each golf ball, with the mean value being taken as the coefficient of restitution of each ball and expressed as an index, with the value of the index in Example 9 being taken as 100. A higher index corresponded to a higher rebound characteristic, and thus a good result.

(3) Spin amount

After a sand wedge (SW) was mounted to a swing machine manufactured by True Temper Co., and the spin amount when hit a golf ball at a head speed of 20 m/sec was measured.

(4) Controllability at rough shot

Five golf players made approach shots using sand wedges both from normal and rough lies. The controllability at approach shot made from the rough lies was evaluated against that of approach shots made from the normal lies according to the ease with which spin could be applied. The evaluation levels were as follows:

Evaluation Level

5: Hardly any difference in spin; good controllability
4: Slightly less spin, but controllability was still good.
3: Less spin, but the effect was hardly noticeable
2: Considerably less spin, with noticeable effect
1: Control impossible as ball had virtually no spin, that is, the flyer occurs Test Results

TABLE 4

| Test item | Example No. 1 | 2 | 3 | 4 | 5 |
|---|---|---|---|---|---|
| Absolute value of phase angle (°) | | | | | |
| Minimum phase angle phase (A) | 53.988 | 71.020 | 62.418 | 56.174 | 66.215 |
| Maximum phase angle phase (B) | 56.297 | 86.980 | 66.141 | 66.365 | 68.234 |
| Phase angle difference (B) - (A) | 2.309 | 15.960 | 3.273 | 10.191 | 2.019 |
| Matrix (continuous phase) | B | B | B | B | B |
| Mean dispersion particle size of A (nm) | 125 | 100 | 151 | 526 | 318 |
| Coefficient of restitution | 102 | 102 | 101 | 101 | 101 |
| Spin amount (rpm) | 6957 | 7172 | 7239 | 6926 | 7453 |
| Controllability at rough shot | 5 | 5 | 5 | 4 | 4 |

TABLE 5

| Test item | Example No. 6 | 7 | 8 | 9 |
|---|---|---|---|---|
| Absolute value of phase angle (°) | | | | |
| Minimum phase angle phase (A) | 64.013 | 61.892 | 58.275 | 59.104 |
| Maximum phase angle phase (B) | 68.205 | 68.131 | 65.781 | 64.770 |
| Phase angle difference (B) - (A) | 4.192 | 6.239 | 7.506 | 5.666 |
| Matrix (continuous phase) | B | B | B | B |
| Mean dispersion particle size of A (nm) | 95 | 189 | 680 | 760 |
| Coefficient of restitution | 102 | 101 | 103 | 100 |
| Spin amount (rpm) | 6418 | 6639 | 6941 | 6825 |
| Controllability at rough shot | 5 | 5 | 4 | 3 |

TABLE 6

| Test item | Comparative Example No. 1 | 2 | 3 |
|---|---|---|---|
| Absolute value of phase angle (°) | | | |
| Minimum phase angle phase (A) | 58.981 | 65.392 | 36.275 |

TABLE 6-continued

| Test item | Comparative Example No. 1 | 2 | 3 |
|---|---|---|---|
| Maximum phase angle phase (B) | 66.279 | 65.392 | 42.836 |
| Phase angle difference (B) - (A) | 7.298 | 0 | 6.561 |
| Matrix (continuous phase) | A | — | A |
| Mean dispersion particle size of A (nm) | 670 | — | 540 |
| Coefficient of restitution | 102 | 104 | 100 |
| Spin amount (rpm) | 5563 | 5124 | 6435 |
| Controllability at rough shot | 1 | 1 | 2 |

As can be seen from the results in the above Tables 4 to 6, the golf balls of the present invention of Examples 1 to 9 as compared with the golf balls of Comparative Examples 1 to 3 exhibited high spin amount at approach shot and demonstrated exceptional controllability at approach shot from the rough, while maintaining high coefficient of restitution. The golf ball of Example 9 had a mean dispersion particle size which was large and therefore, when hit from the rough, it had lower backspin amount than the balls of the other Examples. Though its controllability at rough shot was better than the golf balls of the Comparative Examples, it was not quite as good as the other Examples.

On the other hand, the golf ball of Comparative Example 1 demonstrated a very low spin amount at approach shot, and owing to it having a morphology whereby the minimum phase angle phase in the cover material was the matrix, its controllability at approach shot from the rough was quite poor.

The golf ball of Comparative Example 2 demonstrated a very low spin amount at approach shot and with no phase angle difference being evident in the cover material, the phase was continuous. The coefficient of restitution was high; however, the controllability at approach shot from the rough was quite poor. The golf ball of Comparative Example 3 demonstrated a low spin amount at approach shot, and, owing to it having a morphology whereby the minimum phase angle phase in the cover material was the matrix, its controllability at approach shot from the rough was quite poor.

What is claimed is:

1. A golf ball comprising a core and a cover covering the core, wherein the base resin of the cover is formed from a material having at least two phases whose phase angle difference is at least 2 degrees as measured by using an atomic force microscope; a maximum phase angle phase, which is contained in the base resin of the cover and has an absolute value of a maximum phase angle, is present in the form of a continuous matrix; and a minimum phase angle phase, which has an absolute value of a minimum phase angle, is present in discrete locations within the matrix.

2. The golf ball according to claim 1, wherein the minimum phase angle phase has a mean dispersion particle size of 700 nm or less.

* * * * *